US006043422A

United States Patent [19]

Chapman

[11] Patent Number: 6,043,422

[45] Date of Patent: Mar. 28, 2000

[54] COMPARTMENTALIZED PICKUP MODULE FOR STRINGED MUSICAL INSTRUMENTS

[76] Inventor: Emmett H. Chapman, 6011 Woodlake Ave., Woodland Hills, Calif. 91367-3238

[21] Appl. No.: 09/241,664

[22] Filed: Feb. 1, 1999

[51] Int. Cl.[7] ..... G10H 3/00

[52] U.S. Cl. ..... 84/723; 84/743

[58] Field of Search ..... 84/723, 743

[56] References Cited

U.S. PATENT DOCUMENTS

| | | | |
|---|---|---|---|
| H1503 | 12/1995 | Threadgill | 84/723 |
| 4,254,683 | 3/1981 | Nulman | 84/743 X |
| 4,425,831 | 1/1984 | Lipman | 84/743 |
| 4,433,603 | 2/1984 | Siminoff | 84/743 X |
| 5,252,777 | 10/1993 | Allen | 84/743 X |
| 5,637,823 | 6/1997 | Dodge | 84/743 |
| 5,767,432 | 6/1998 | Randolph | 84/743 |
| 5,854,437 | 12/1998 | Merrick et al. | 84/723 X |

*Primary Examiner*—Jeffrey Donels
*Attorney, Agent, or Firm*—J. E. McTaggart

[57] ABSTRACT

A compact active pickup module, directed particularly to bodiless stringed musical instruments, has a main enclosure machined from dense solid material to provide a complex of internal compartments and is configured with a six-sided, diagonally-elongated shape consistent with the appearance of The Chapman Stick (R). Mounted in an elongated channel running diagonally across the instrument through-neck structure in a thick portion thereof near the lower (bridge) end, the module can be easily installed and removed sideways without removing the strings or disturbing their tuning. The module is held in place with two machine screws that are accessible between strings, and is mounted resiliently for isolation against unwanted vibrations from the bodiless through-neck structure. The enclosure is machined at various depths from the rear to provide numerous separate cavities forming compartments for accommodating components of the pickup module, including typically two pickups, associated buffer electronics, two sets of volume and tone controls, a function switch, e.g. stereo/mono, and a battery. An embodiment for a ten-string instrument utilizes dual pickups in an effectively end-to-end arrangement for bass and melody string groups, switch-selectable to operate in stereo or mono. A smaller module for a six string guitar or four string bass guitar has two pickups located at different spacing from the bridge for timbral variation. In all embodiments the module can be removed and reinstalled in an inverted orientation for a different bridge-to-pickup spacing that alters the tone of the instrument.

27 Claims, 9 Drawing Sheets

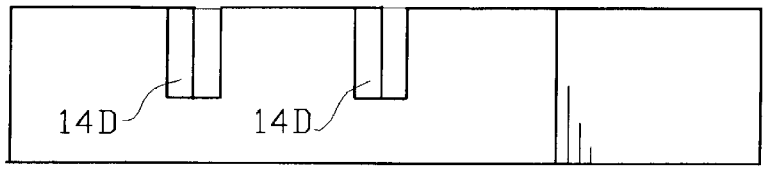
FIG. 3B
FIG. 3A
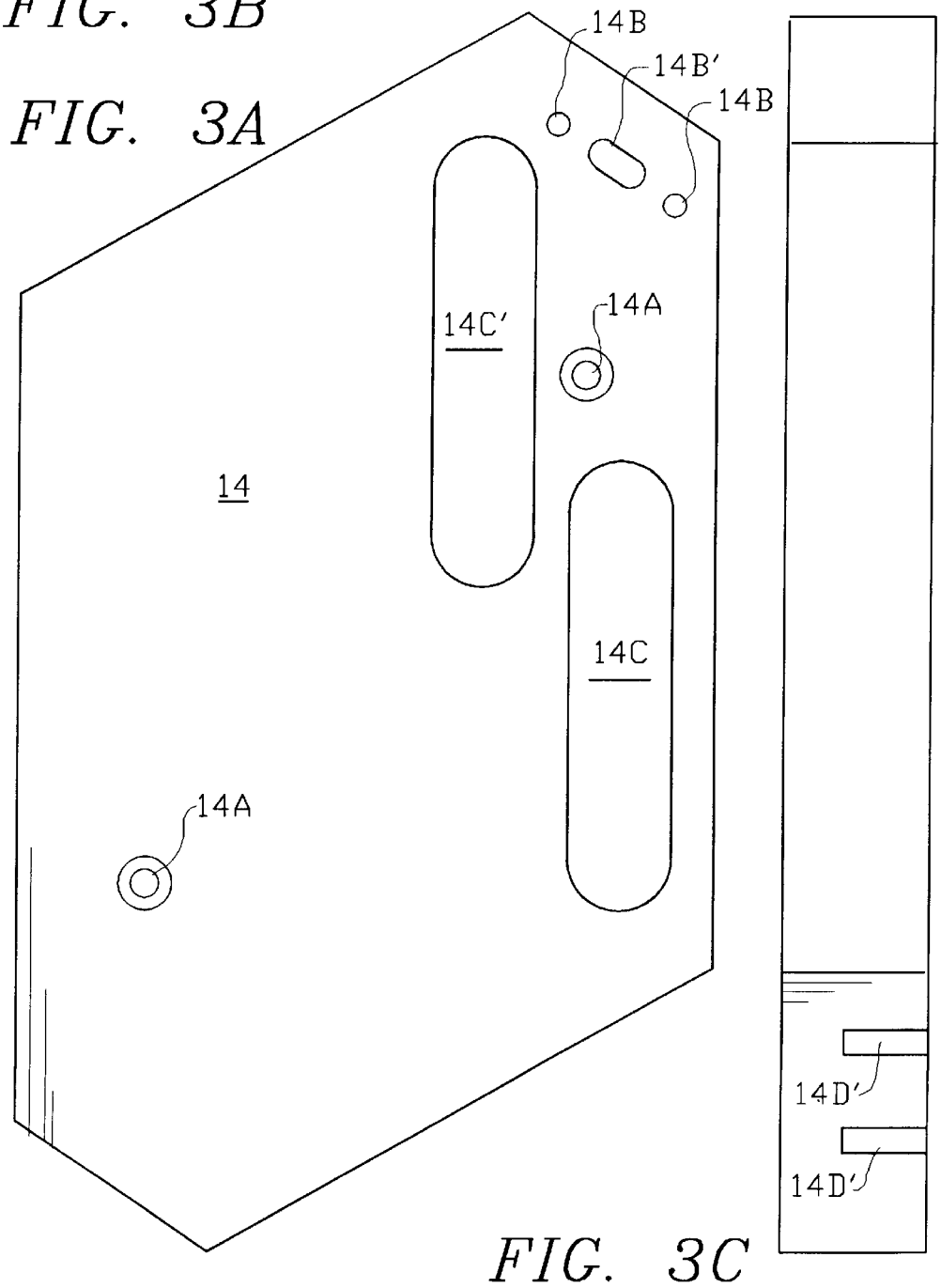
FIG. 3C

COMPARTMENTALIZED PICKUP MODULE FOR STRINGED MUSICAL INSTRUMENTS

FIELD OF THE INVENTION

The present invention relates to the field of amplified stringed musical instruments and more particularly it relates to an electric pickup module for bodiless stringed instruments intended for playing by a two-handed tapping technique as well as for such instruments intended for playing by conventional strumming and/or plucking technique. A unique and distinctively shaped enclosure is machined from dense solid material to provide a plurality of compartments for containing pickups and associated components integrated in a self-contained compact module that mounts in an easily removable and reversible manner in a channel running diagonally across the through-neck structure of a bodiless instrument near the bridge end.

BACKGROUND OF THE INVENTION

Stringed musical instruments such as guitars have evolved from their original hollow-body acoustic form; with the advent of electronic sound reinforcement, adaptive pickups were added, typically mounted on a strip extending across the round sound hole of the instrument. Electro-acoustic models were designed to be originally equipped with a built-in pickup but retaining the hollow body to provide substantial acoustic output. The "electric" guitar with a solid body and thus lacking any substantial acoustic output and instead relying on amplification, became immensely popular.

In the "electric" guitar, the solid body was often configured in a shape suggestive of the traditional guitar body but made somewhat smaller for weight balance considerations while functioning to provide the mounting arrangements for the pickup(s) and associated components such as volume and tone controls, and to provide weight balance.

This trend to a smaller instrument body found ultimate expression in the development of The Chapman Stick a.k.a. The Stick (R) (federally registered trademark) which is played in an independent two-handed string-tapping manner: the body was virtually eliminated by configuring the instrument as a through-neck structure carrying near the bridge end a compact pickup housing incorporating the associated electronic components such as tone and volume controls, mode switches, battery power supply, etc.

The resulting distinctively elegant elongated rectangular shape of the through-neck structure with the tuning mechanism appearing in the headstock at the upper end and the pickup/control housing extending diagonally as small protrusions just above the bridge at the lower end, is universally recognized and associated with the illustration shown in the company's federally registered logo trademark.

Typically in electric guitars the pickups and their associated components are mounted in a relatively permanent manner with little or no regard to ease of servicing and/or replacement, due to limitations imposed by the body construction, whether solid or hollow. However, it is sometimes desired to replace a defective pickup unit and/or associated controls, especially potentiometers which are subject to mechanical deterioration. Also, with advancing technology, it has become more frequently desired to replace the pickup unit with another that is new, improved and/or different, e.g. one having different timbral qualities. Such replacement is made difficult by the conventional practice in which the pickups and their associated components are spread out and interconnected over various locations on the instrument body, and are thus not only costly to assemble in initial production but also difficult and troublesome to service when the pickups themselves are mounted in an unserviceable recessed manner in the solid body, making removal and replacement difficult, time-consuming and expensive. Pickups and associated components that cannot be removed without first removing the instrument strings involve costly and time-consuming re-stringing and retuning.

DISCUSSION OF RELATED KNOWN ART

U.S. Pat. Nos. 5,401,900 and 5,438,158 exemplify musical instrument pickup assemblies for use with hollow body acoustic guitars.

U.S. Pat. Nos. 3,992,972 and 4,184,399 exemplify musical instrument pickup assemblies for use with solid body electric guitars.

U.S. Pat. Nos. 3,833,751, 3,868,880, 4,633,754, 4,953,435 and 5,285,710 to Chapman, the present inventor, relate to instruments of the Chapman Stick family characterized by an elongated bodiless through-neck structure carrying a small pickup housing and typically ten uniquely-tuned strings played by a two-independent-handed string tapping technique wherein each hand is oriented at right angles to the strings approaching the fret board from opposite sides, a playing method created by the present inventor in 1969.

OBJECTS OF THE INVENTION

It is a primary object of the present invention to provide a modular pickup unit that fully contains one or more pickups and all associated components in a compact enclosure for use on an electronically amplified stringed instrument such as the guitar, string bass or the Chapman Stick.

It is a further object that the modular pickup unit be configured so as to be easily installable and removable without removing the strings.

It is a further object to configure the modular pickup in a manner to provide two mounting options regarding relative location of the pickup along the strings.

It is another object to expand the sonic versatility of the associated instruments by offering a product line of interchangeable modular pickup units containing different brands and generic types of pickups.

It is a further object to mount the module resiliently so as to dampen vibrations emanating from the through-neck structure.

It is still further object, while retaining compact size, to add sufficient mass to the module to lower the resonant frequency to further dampen the unwanted vibrations, especially those of higher frequency.

It is an object of this invention to provide a pickup module enclosure that will serve to protect the ends of contained pickups that extend outwardly past the through-neck structure.

SUMMARY OF THE INVENTION

The abovementioned objects have been accomplished by the present invention of an active pickup module enclosure which in a preferred embodiment is essentially fashioned from a slab of solid material so as to accomplish both compactness and relatively high mass. A preferred embodiment is made to have a six-sided, diagonally-elongated shape, generally similar to pickup enclosures presently used in other popular models of The Stick, but enlarged in the direction of the strings to allow more room for the electronics. The module fits into an elongated channel diagonally traversing the instrument through-neck structure in a thick portion thereof near the bridge at the lower end; it can be installed and removed without removing the strings or even disturbing their tuning. The pickup module, known as "The Block", fastens in place with two machine screws, each made accessible from the front between a pair of strings.

The module enclosure is machined with separate cavities that form compartments for the electronic components, including typically two active pickups, associated buffer electronics, two sets of volume and tone controls, an output jack, a stereo/mono switch and a battery.

The module is resiliently mounted with rubber or equivalent. In machining the cavities in the enclosure, as much of the solid material as possible is left in place so as to retain substantial mass, thus lowering the mechanical resonant frequency and damping sympathetic vibrations at higher frequencies.

BRIEF DESCRIPTION OF THE DRAWINGS

The above and further objects, features and advantages of the present invention will be more fully understood from the following description taken with the accompanying drawings in which:

FIG. 3A is a front view of a machined stereo/mono pickup module enclosure embodying the present invention.

FIG. 3B is a top view of the enclosure of FIG. 3A.

FIG. 3C is a right side view of the enclosure of FIG. 3A.

FIG. 4A is a rear view of the enclosure of FIG. 3A.

FIG. 4B is a side view of the enclosure of FIG. 4A.

DETAILED DESCRIPTION

Figure 1:
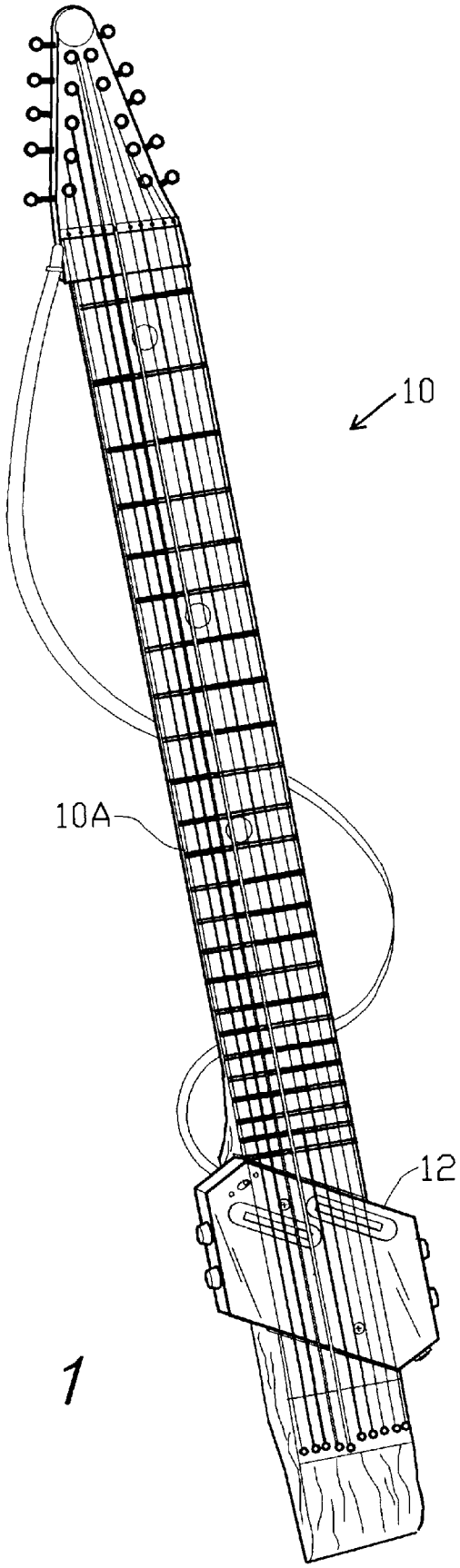
FIG. 1 is a three-dimensional view of a bodiless 10-string instrument, the Chapman Stick (R), utilizing a compartmentalized pickup module in a preferred embodiment of the present invention.

In FIG. 1, the three-dimensional view depicts a bodiless 10-string instrument 10 consisting of two main portions: a through-neck structure 10A as the main end-to-end portion that has been developed by Stick Enterprises and marketed under the trademark The Chapman Stick and The Stick, and a compartmentalized pickup module 12 that constitutes a preferred embodiment of the present invention.

The main enclosure of module 12 is machined from solid plastic material so as to provide numerous compartments for containing two active pickups and all of the associated electronics and components. Module 12 fits into a diagonal channel machined into a thickened portion of through-neck structure 10A. This channel mounting allows module 12 to be installed and removed easily in a diagonal sideways direction without removing the strings or disturbing their tuning.

Pickup module 12 can be retrofitted onto new and used 10-string Sticks with minor modification: information is available from Stick Enterprises.

Figure 2A:
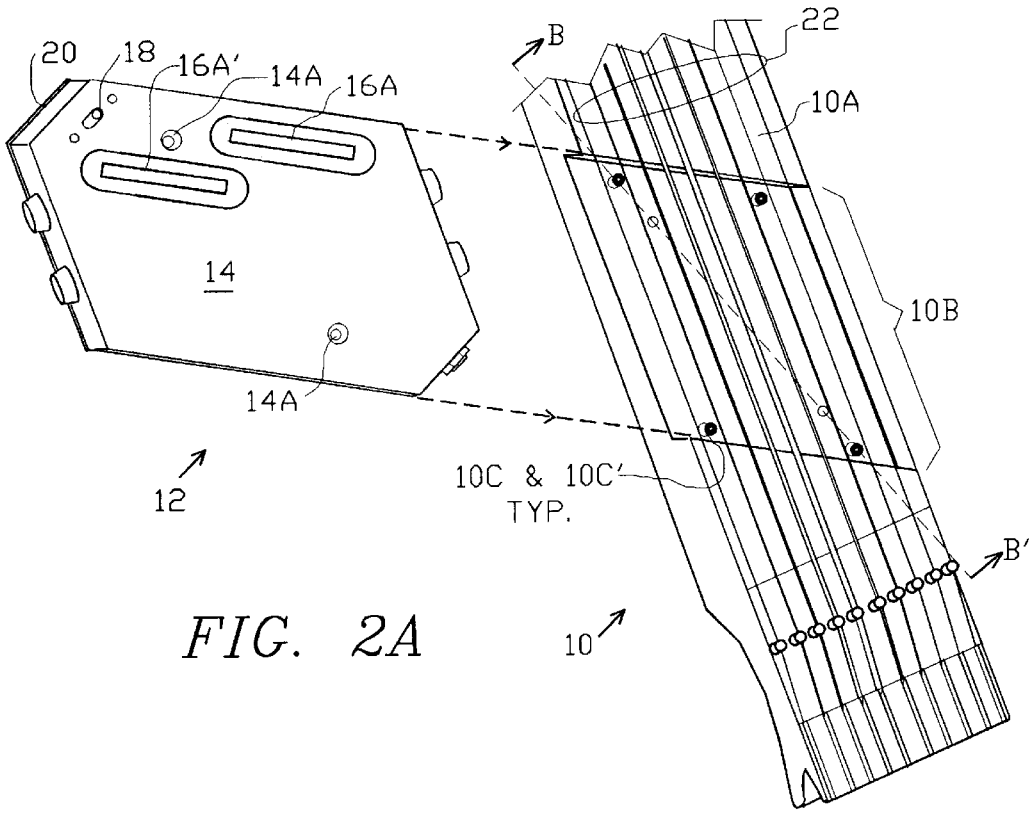
FIG. 2A is an enlargement of a portion of the through-neck structure of the instrument shown in FIG. 1 with the pickup module removed and shown separately.

FIG. 2A depicts the lower portion of the through-neck structure 10A of instrument 10 of FIG. 1 with module 12 removed to the left side to show the diagonal channel 10B provided in the thickened portion of the through-neck structure 10A just above the bridge region at the lower end. The floor surface of channel 10B forms a parallelogram; near each of its four corners, a rubber-tip 10C of a set screw extends upwardly to provide adjustable resilient support for module 12. A pair of stepped holes 14A pass fully through module 12 for mounting purposes.

Two separate pickups 16A and 16A' are utilized, each sensing a 5-string group of the 10 string total; pickup 16A senses the higher-pitched melody or treble string group while pickup 16A' senses the lower-pitched bass string group. The two pickups are identical commercially available units; they are placed at an angle and overlapped as shown to ensure full pickup of all strings, especially at the inner ends of the pickups 16A and 16A'.

Alternative custom pickup design could possibly allow the two pickups to be located in-line, either as two units placed end-to-end or with the two pickups incorporated in a single full length in-line unit.

The outputs of the two pickups 16A and 16A' may be amplified separately as stereo signals or combined as a mono signal, as selected by a stereo-mono switch 18, which is accessible from the front of module 12.

Enclosure 14 is fitted at the rear with a backplate 20 which supports module 12 on the rubber-tips 10C.

In this preferred embodiment, the enclosure 14 of module 12 is made ⅞" thick and channel 10B is made ⅞" deep. The through-neck structure 10A is made about 1¾" thick and essentially rectangular in cross-section in the thickened region containing the channel 10B, and the neck is made ⅞" thick throughout the fretboard region.

Figure 6:
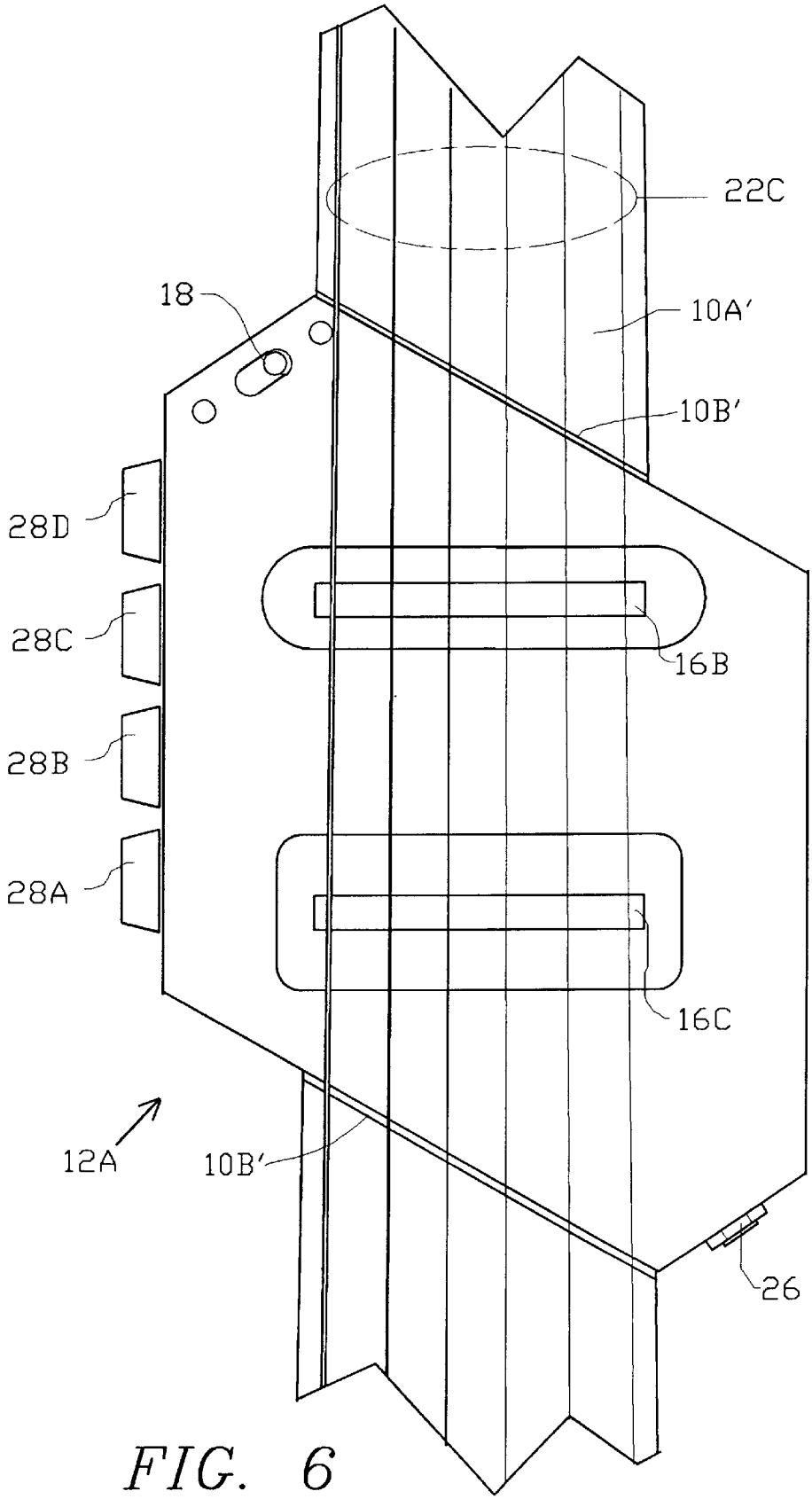
FIG. 6 is a front view of a portion of a through-neck structure of a 6-string bodiless guitar equipped with a dual-pickup embodiment of the present invention.
Figure 7:
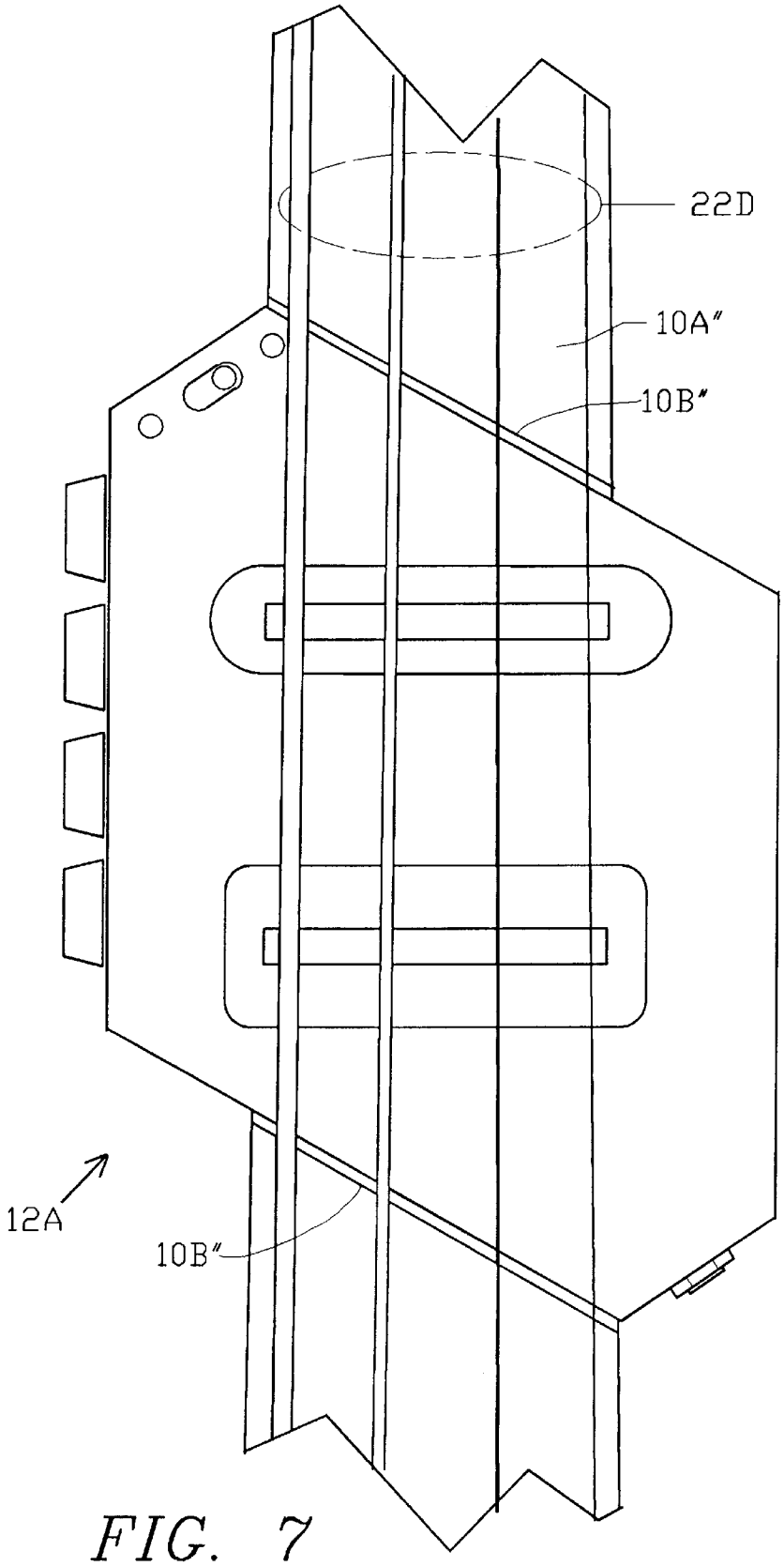
FIG. 7 is a front view of a portion of a through-neck structure of a 4-string bodiless bass guitar equipped with a dual-pickup embodiment of the present invention, similar to that in FIG. 6.

For other embodiments, particularly for 4-string or 6-string instruments, a single commercially-available pickup could be utilized for all strings; or, as commonly found in electric guitars, dual pickups, each sensing all strings, could be placed at different locations along the strings for tonal variation (Refer to FIGS. 6 and 7).

Figure 2B:
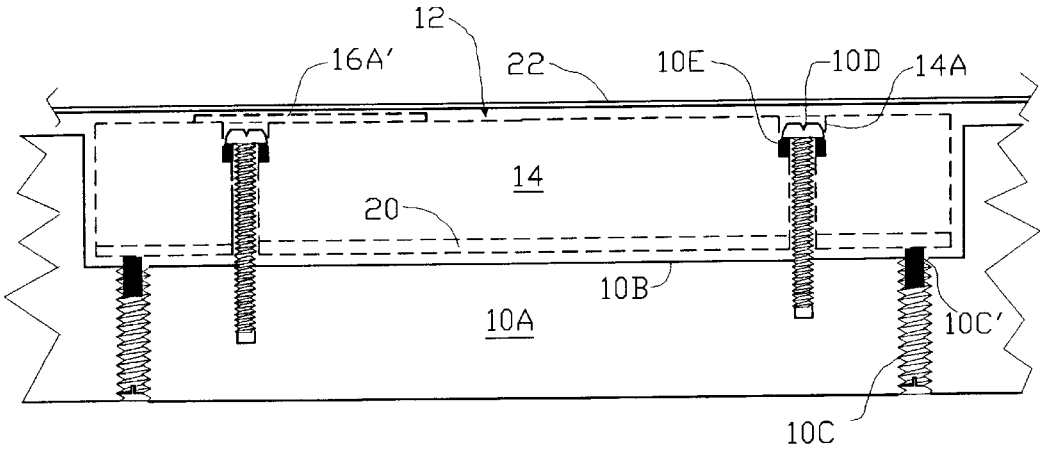
FIG. 2B is a cross-section taken from FIG. 2A showing details of the resilient suspension and attachment of the module.

FIG. 2B is an enlarged cross-section taken through B–B' of FIG. 2A to include two diagonally opposite rubber tips 10C'. The installed location of module 12 is shown in dashed outline including enclosure 14 and back plate 20 supported by the rubber tips 10C', which are rubber cylinders of 0.150" diameter fitted into holes provided in the ends of ¼" set screws 10C. Threaded into tightly-fitting through-holes in the through-neck structure 10A, set screws 10C are thus accessible for adjustment from the bottom side.

The pickup module 12 is levelled and set for general height relative to the strings 22 by adjustment of the four set screws 10C. Module 12 is then retained in place by the two machine screws 10D inserted into stepped mounting holes 14A and threaded into tight-fitting blind holes provided in the through-neck structure 10A. Rubber washers 10E under the heads of the two screws 10D in the stepped holes serve along with the four rubber tips 10C' on set screws 10C to provide a resilient mounting for module 12, which is spaced apart from the walls of channel 10B.

The compartments machined from the solid material in enclosure 14 are kept as small as possible so that a substantial amount of the dense material remains in place typically ⅓ to ½ of the total volume, in order to maximize the mass of module 12 while minimizing its size. Consequently, the combination of the resilient mounting and the substantial mass of module 12 despite its compact size, sets the mechanical resonance to a low frequency and thus acts to isolate pickups 16A and 16A' from unwanted vibrations that can occur at higher frequencies in the through-neck structure 10A when the instrument is played.

Set screws 10C and machine screws 10D can be threaded directly into the through-neck structure 10A if it is made from suitable material such as a high quality grade of hardwood and the hole size is suitably selected. Alternatively metal bushings or equivalent known hardware devices could be utilized to engage set screws 10C and/or machine screws 10D.

In addition to the overall module height adjustment provided by set screws 10C, which is not available in conventional guitars, pickups 16A and 16A' are mounted in enclosure 14 in a manner to be independently adjustable for height in setting the spacing relative to the strings.

Back plate 20 can be of metal or plastic for its mechanical function of receiving mounting support; for electrical/RF shielding purposes it is preferably made to be conductive and connected securely to a common ground.

FIG. 3A, a front view of the enclosure 14 of module 12 (FIGS. 1–2B), shows the two stepped mounting holes 14A, and, at the upper right a three-hole group including two mounting holes 14B and an access opening 14B' for accommodating a stereo-mono switch (18 in FIG. 2A). The two large elongated openings 14C and 14C' traversing through enclosure 14 are for containing the pickups (16A and 16A' in FIG. 2A).

Enclosure 14 is machined from a solid piece of dense material, made 0.8751" thick in this embodiment. The two stepped mounting holes 14A are each configured as a 0.170 diameter through-hole and a 0.3101" diameter counterbore 0.300" deep, to accommodate the #10×1 3/16" machine screws (10D in FIG. 2B). The long perimeter regions at the left and right are made 5.0" in length, the medium length perimeter regions at the top and bottom are made approximately 3½" long, and the short perimeter regions at the top and bottom are made approximately 1⅜".

In FIG. 3B, a top view of enclosure 14 of module 12 as shown in FIG. 3A, two channels 14D are provided for mounting the bass volume and tone controls in the top medium length perimeter region.

Similarly, FIG. 3C, a right side view of enclosure 14, shows two additional channels 14D' for mounting the melody volume and tone controls in the bottom medium length perimeter region.

FIG. 4A is a rear view of enclosure 14 showing the various cavities formed as compartments of different sizes and shapes by machining enclosure 14 to different depths relative to the rear surface.

Pickup mounting though-openings 14C and 14C' are configured with ledges at each end that are 0.550" in depth from the rear surface, while the main opening extends fully through enclosure 14. Openings 14C and 14C' are shaped as shown to accommodate a popular type of magnetic pickup that is commercially available for electric guitars and bass guitars.

Compartment 14D at the upper short peripheral region accommodates the stereo-mono switch 18 (shown in FIG. 2A).

Compartment 14E, made 0.680" deep, accommodates the bass volume and tone controls, to be mounted in channels 14F, which are made 0.500" deep.

Compartment 14G, also made 0.680" deep, extending through the right edge of enclosure 14, accommodates a 9 volt battery.

Compartment 14H is made 0.680" deep to contain a pair of buffer circuits that implement the pickup preamplification system including volume and tone control functions.

Compartment 14J, made 0.750 deep, is made to contain a switching type phone jack which is mounted in a 0.375" round hole 14K drilled through the perimeter region as shown, to serve as the output port of the pickup module.

Compartment 14L, similar to compartment 14E at the opposite end, accommodates the melody volume and tone controls, to be mounted in channels 14F'.

Surface 14M is the zero depth rear surface, defining the solid regions of full thickness including the solid region extending from the access opening 14G' of battery compartment 14G so as to form the major portion of the perimeter of enclosure 14.

A common central region, defined by a flat main floor surface 14N machined to a depth of 0.450" from the rear surface, provides conduit space for hookup wiring interconnecting the various components contained in enclosure 14.

FIG. 4B, a view of enclosure 14 from the right side of FIG. 4A as shown, shows channels 14F in the top medium length perimeter region, the access opening 14G' of battery compartment 14G in the long perimeter region, and the phone jack mounting hole 14K in the bottom short perimeter region.

Figure 4C:
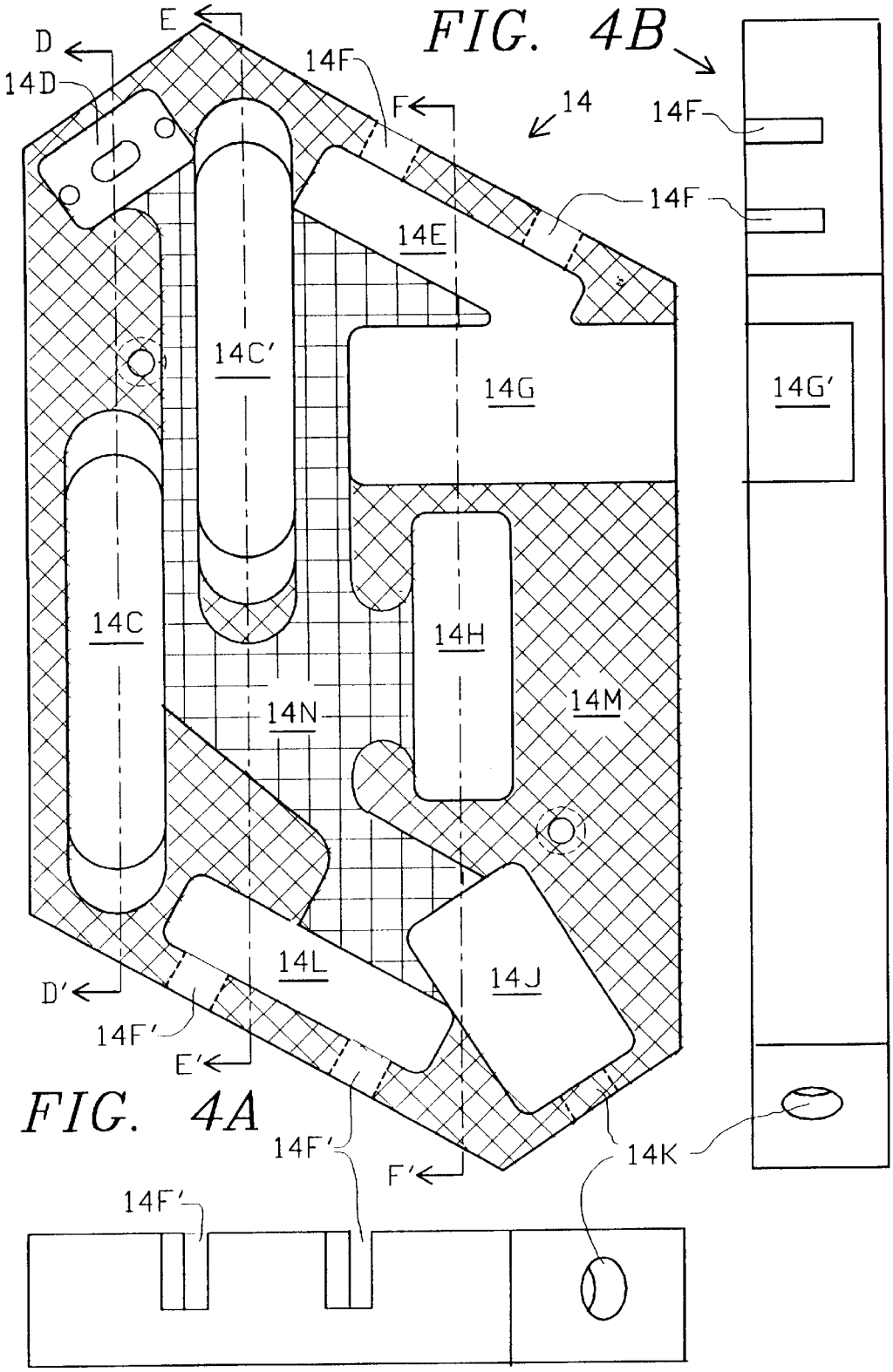
FIG. 4C is a bottom view of the enclosure of FIG. 4A.

FIG. 4C, a view of enclosure 14 from the bottom of FIG. 4A as shown, shows channels 14F' in the medium length perimeter region and the phone jack mounting hole 14K in the short perimeter region.

Figure 4D:
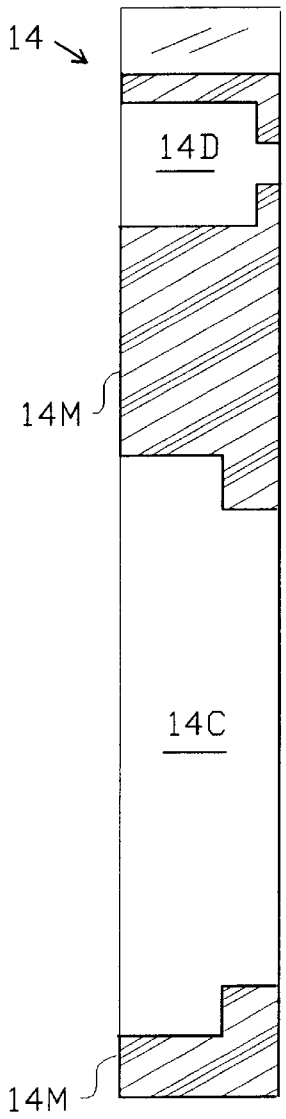
FIG. 4D is a cross-section taken through D–D' of FIG. 4A.

FIG. 4D, the cross-section taken through D–D' of enclosure 14 in FIG. 4A, shows switch compartment 14D and pickup opening 14C.

Figure 4E:
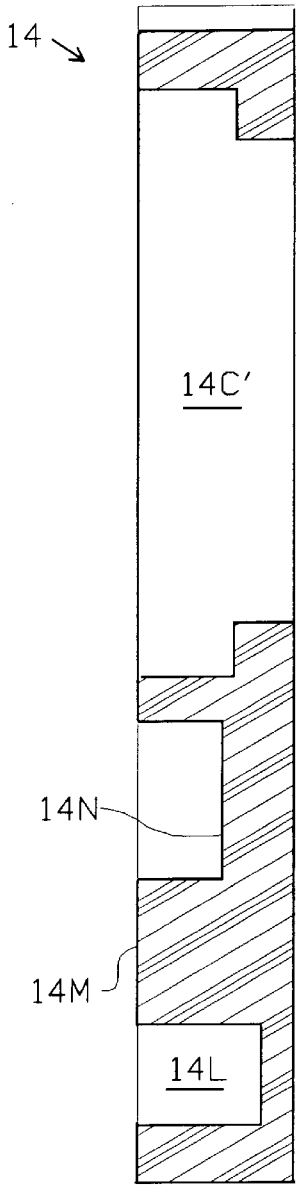
FIG. 4E is a cross-section taken through E–E' of FIG. 4A.

FIG. 4E, the cross-section taken through E–E' of enclosure 14 in FIG. 4A, shows pickup opening 14C', part of wiring region 14N and control compartment 14L.

Figure 4F:
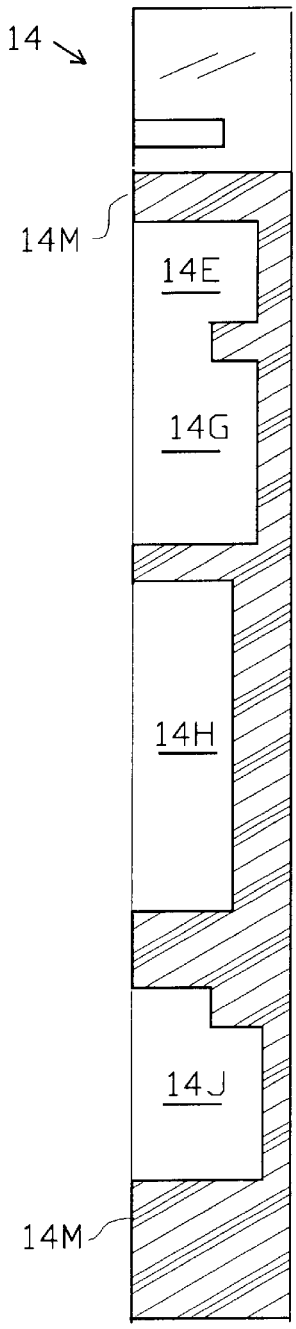
FIG. 4F is a cross-section taken through F–F' of FIG. 4A.

FIG. 4F, the cross-section taken through F–F' of enclosure 14 in FIG. 4A, shows control compartment 14E, battery compartment 14G, buffer compartment 14H and output jack compartment 14J.

Figure 5A:
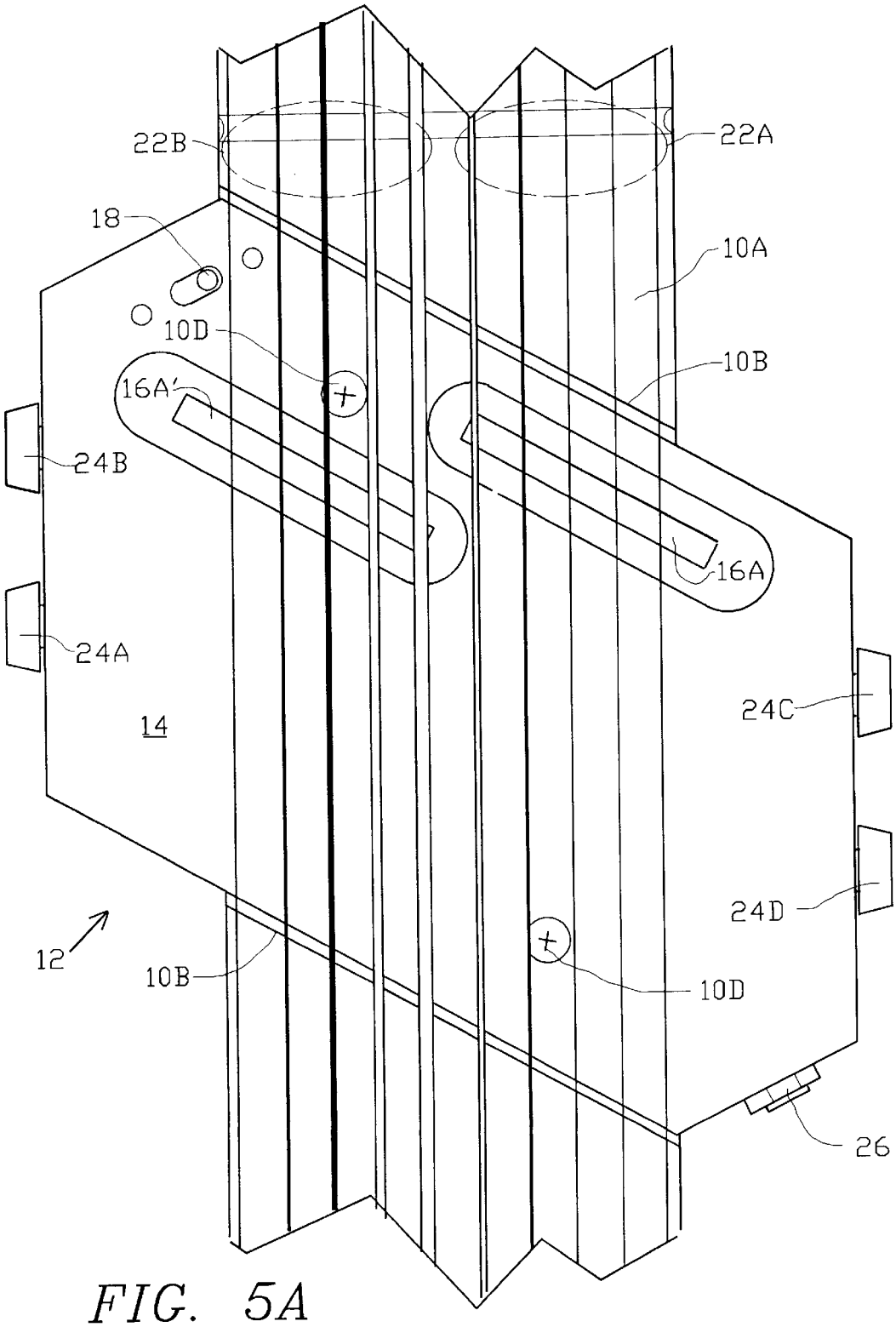
FIG. 5A is a front view of a portion of the through-neck structure of a Stick (R) 10-string fretted tapping instrument fitted with a stereo-mono pickup module of the present invention, mounted in a first of two possible orientations.

FIG. 5A is a front view of a portion of a through-neck structure 10A of a bodiless stringed instrument fitted with a stereo/mono pickup module 12 mounted in the channel 10B, as in FIGS. 1A–2C according to the present invention. This embodiment has 10 parallel strings in two groupings: 5 melody strings 22A and 5 bass strings 22B. The pickup module 12 is mounted to through-neck structure 10A as described in connection with FIGS. 2A and 2B, the sidewalls of channel 10B conforming with the long perimeter regions of enclosure 14, which is secured in place by machine screws 10D threaded into the through-neck structure 10A. This mounting allows the pickup module 12 to be easily installed and removed in either of two opposite orientations by sliding it sideways in the channel of through-neck structure 10A without having to remove, loosen or detune the strings 22A–B.

The volume and tone controls 24A–D are entirely independent on the bass and melody sides. The stereo/mono switch 18 transfers the melody side from its own output to combine with the bass output ("tip" of the Stick stereo cable). In mono mode, either a mono guitar cable or the accessory Stick stereo cable can be deployed, plugging in to jack 26, which is of the switching type, arranged to control battery power turn-on.

The electronics of module 12 can include two internal trim potentiometers associated with active buffer circuits that set mono volumes of the bass and melody sides independently.

The mounting orientation shown in FIG. 5A locates pickups 16A and 16A' near the upper perimeter of module 12, with their mid-point at a distance along the strings about 6¼" from the bridge: the ratio of this pickup-to-bridge dimension to string scale length determines the harmonic content and thus the overall tonal characteristics of the pickup response.

Figure 5B:
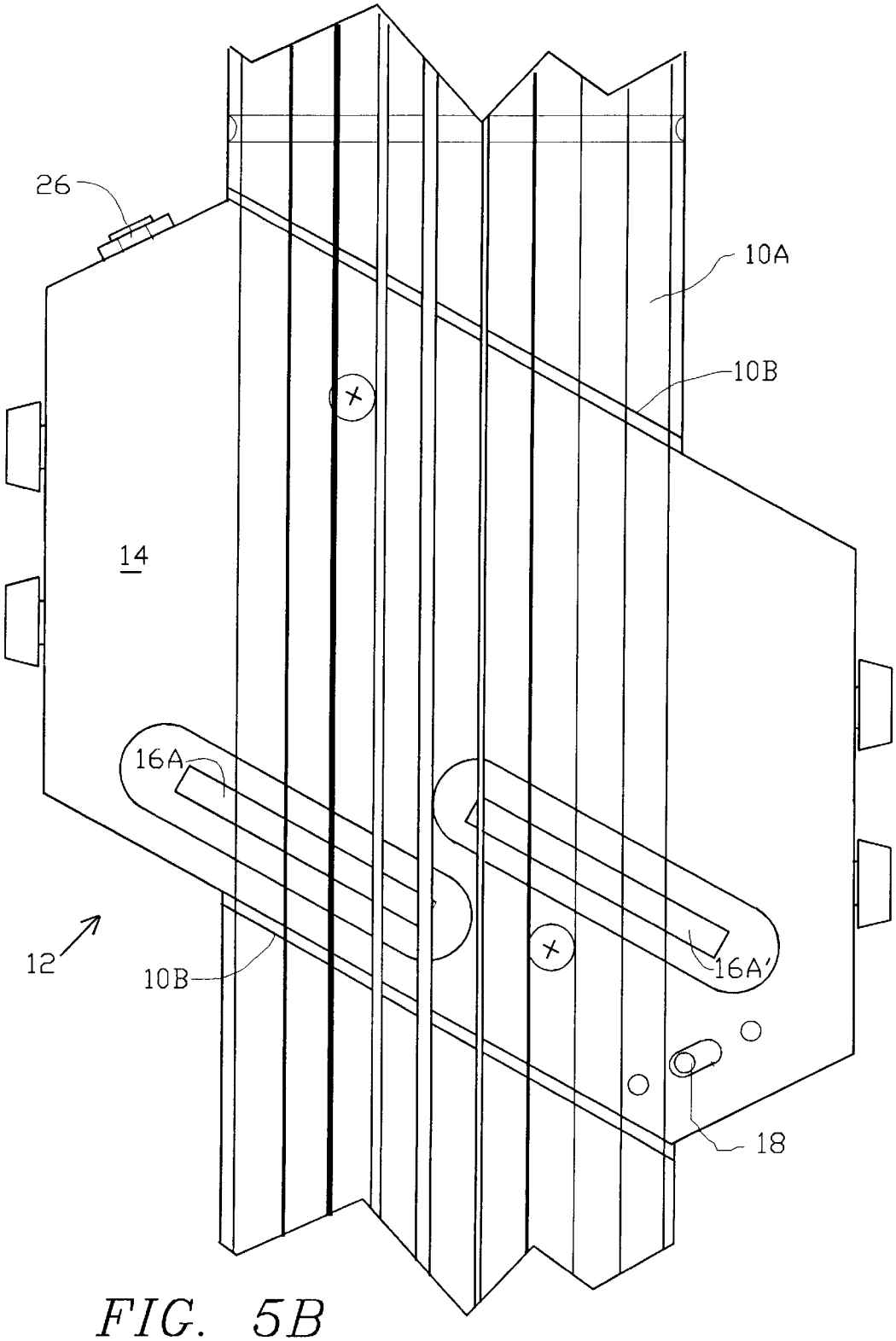
FIG. 5B, similar to FIG. 5A, shows the pickup module mounted to the through-neck structure in the alternative orientation, reversed relative to that shown in FIG. 5A, thus locating the pickups closer to the bridge region at the lower end of the instrument.

FIG. 5B shows the pickup module 12 mounted to the through-neck structure 10A in the alternative orientation, reversed relative to that shown in FIG. 5A and thus locating pickups 16A and 16A' near the bottom perimeter of module 12 as shown. This pickup location provides a tonal variation option with modified harmonic content due to the pickup-to-bridge spacing being reduced to about 3¼", i.e. about half of the spacing provided in the original orientation shown in FIG. 5A.

FIG. 6 shows a front view of a dual pickup embodiment of the invention intended for a 6-string instrument. Module 12A, a smaller version of module 12 described above, is shown mounted on a through-neck structure 10A' of a bodiless instrument having six strings 22C, which, as with a conventional guitar, may be non-parallel, diverging toward the bridge (bottom) end.

The two pickups 16B and 16C are preferably of different types so to provide additional tonal variety; they may be independently controlled from two corresponding sets of volume and tone controls via knobs 28A–28D.

A function switch 18, e.g. for pickup selection, may be located on the upper short perimeter region of module 12A; and the output phone jack 26 may be located at the opposite lower short perimeter region as shown. The smaller enclosure of module 12A is configured with two through-openings for the pickups and is machined from the rear to provide a plurality of compartments for the various components in the same general manner as for the larger enclosure 14 of module 12 described above.

FIG. 7 shows module 12A as in FIG. 6 mounted to the through-neck structure 10A" of a bodiless bass guitar having four strings 22D.

In any of the embodiments shown and described above the module can be fitted into a diagonal channel cut into the through-neck structure of the stringed instrument as indicated and as shown in FIG. 2A; typically the through-neck structure would be made thicker in the region contouring the channel to preserve strength.

As an alternative to making the module of uniform thickness as shown above, the module could be configured with a shallow channel at the rear dimensioned to accommodate the through-neck structure, which could thusly be made thinner at that region because its diagonal channel could be made correspondingly shallower while still allowing lateral installation and removal of the module without disturbing the strings. A deeper channel in the module could eliminate the need for a channel in the through-neck structure and allow it to be of uniform small thickness throughout, however easy lateral removal would no longer be possible. Another alternative module enclosure configuration could be stepped at the rear to have two or even three back surface levels, making one end region of the module thicker to accommodate components and the other end thin enough to allow easy lateral installation and removal in the one available direction without string removal. This lateral removal capability is readily adaptable to instruments of bodiless through-neck construction; however it could be accomplished on the more conventional solid or hollow body stringed instrument if a cavity region is provided to one side of the pickup module large enough to allow lateral installation and removal in that one available direction.

In addition to the 4-, 6- and 10-string instruments described above, the principles of the present invention can be applied to and practiced generally with bodiless instruments having any desired number of strings, such as 8- or 12-strings, or an odd number of strings.

The enclosure may be machined from a block of black acetal plastic material such as Delrin. Alternatively the enclosure could be machined from suitable metal such as aluminum, or, in general it could be machined, cast or molded from metal, plastic or other suitable material such as wood or solid composite material. For shielding against power line hum and RF interference, electrically conductive material would be preferable in both the enclosure and the back plate; however, with good shielding practices observed on each component and the interconnecting wiring, a plastic enclosure with a grounded metal back plate can provide adequate shielding.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A compartmentalized pickup module enclosure, for a stringed musical instrument having a designated number of strings, comprising:

a main enclosure portion made from dense solid non-sheet material selected from a group including plastic. metal, wood and solid composite material, and made in a process selected from a group including machining, molding and casting, having a front surface, a rear surface and a plurality of peripheral facets, said enclosure portion being configured with a plurality of recessed compartments, each extending inwardly from the rear surface, configured and arranged to accommodate at least a first pickup along with a plurality of components, controls and interconnections associated with the pickup and to thus enable the assembly of a substantially self-contained pickup module;

said main enclosure portion being configured to provide at least a first pickup compartment dimensioned and arranged to surround and mount the pickup in an operational disposition for sensing at least a portion of the designated number of strings, and to provide an output jack compartment configured and arranged to contain and mount a user-accessible output phone jack.

2. The compartmentalized pickup module enclosure as defined in claim 1 as directed to a bodiless stringed instrument having a through-neck structure extending from a head end to a bridge end of the instrument; and said module enclosure portion being configured and arranged to enable the module to be mounted in a substantially transverse channel provided near the bridge end in the through-neck structure whereby the module is enabled to be installed and removed sideways without disturbing the strings.

3. The compartmentalized pickup module enclosure as defined in claim 1 further configured to provide, in said main enclosure portion, a first control compartment dimensioned and arranged to contain and mount a first user-operable volume control and a first user-operable tone control.

4. The compartmentalized pickup module enclosure as defined in claim 3 wherein said main enclosure portion is further configured with:

a second pickup compartment dimensioned and arranged to surround and mount a second pickup such that, when the module is installed in the instrument, each string will be disposed operationally relative to at least one of the pickups; and a second control compartment dimensioned and arranged to contain and mount a second user-operable volume control and a second user-operable tone.

5. The compartmentalized pickup module enclosure as defined in claim 4 wherein said main enclosure portion is further configured with:

a buffer compartment dimensioned and arranged to contain and mount an electronic buffer circuit unit associated with the pickups and the controls, and a battery compartment dimensioned and arranged to contain and to provide access to a battery associated with the electronic buffer circuit unit.

6. The compartmentalized pickup module enclosure as defined in claim 1, wherein said enclosure is configured and arranged to define a six-sided perimeter pattern of adjoining flat facets having surfaces substantially perpendicular to the front and rear surfaces, the pattern comprising three pairs of facets, each pair consisting of two substantially parallel facets of substantially equal length located at opposite edges of said enclosure.

7. A compartmentalized pickup module for a stringed musical instrument of bodiless construction having a designated number of strings and having through-neck structure extending from a head end to a bridge end of the instrument, comprising:

an enclosure, made from dense solid non-sheet material selected from a group including plastic, metal, wood and solid composite material, and made in a process selected from a group including machining, molding and casting, having a front surface, a rear surface and peripheral walls, configured with a plurality of recessed compartments, each extending inwardly from the rear surface, dimensioned and arranged to accommodate a plurality of components, controls and interconnections associated with the pickup;

a first pickup, contained and mounted in a corresponding one of the compartments in an operational disposition such as to sense at least a portion of the designated number of strings;

a first user-operable volume control and a first user-operable tone control, operationally associated with said first pickup, contained and mounted in a corresponding one of the compartments; and an output jack, operationally associated with the components of said module, contained and mounted in a corresponding one of the compartments.

8. The compartmentalized pickup module as defined in claim 7 further comprising:

a second pickup mounted in a corresponding one of the compartments such that, when the module is installed in the instrument, each string will be disposed operationally relative to at least one of the pickups;

a second user-operable volume control and a second user-operable tone control, operationally associated with said second pickup, contained and mounted in one of the compartments; and a user-operable function switch, operationally associated with said first and second pickups, contained and mounted in a corresponding one of the compartments.

9. The compartmentalized pickup module as defined in claim 8 further comprising:

an electronic buffer circuit unit, having a first portion operationally associated with said first pickup, said first volume control and said first tone control and having a second portion operationally associated with said second pickup, said second volume control and said second tone control, contained and mounted in a corresponding one of the compartments;

a battery designated and arranged to power at least said electronic buffer circuit unit, contained in an accessible manner in a corresponding one of the compartments; and a rear cover plate interfacing the rear surface.

10. The compartmentalized pickup module as defined in claim 9 wherein said first and second pickups are disposed in a manner to each sense a group of strings containing a corresponding half of the designated number of strings, and wherein said function switch is configured and arranged to provide user selection between stereo and mono modes of operation of said first and second pickups.

11. The compartmentalized pickup module as defined in claim 10 wherein the designated number of strings is ten and wherein said first and second pickups are each disposed in a manner to sense a corresponding group of five strings.

12. The compartmentalized pickup module as defined in claim 9 wherein:

said first and second pickups are disposed and arranged to each sense all of the strings at different corresponding displacements from the bridge end; and said function switch is configured and arranged to provide user selection between said first and second pickups as source of an audio signal to be delivered at said output jack.

13. The compartmentalized pickup module as defined in claim 12 wherein the designated number of strings is six.

14. The compartmentalized pickup module as defined in claim 12 wherein the total number of strings is four.

15. A stringed musical instrument having a designated number of metal strings intended for use with audio amplification and having a main structure configured and arranged to retain and tension the strings in a known manner to be played by a musician, comprising;

a pickup module having an enclosure fashioned from a slab of solid material of predetermined original volume by removing material in a manner to provide a plurality of compartments for components of said module and to retain at least one third of the original volume of solid material as a final volume thereof, removably attached to said main structure;

a first pickup, contained in said module, disposed in a manner to sense at least a portion of the designated number of strings;

said main structure and said pickup module being configured and arranged to enable easy installation of said pickup module into said main structure, and easy removal therefrom, in a sideways direction, without disturbing the strings.

16. The stringed musical instrument as defined in claim 15 wherein said main structure comprises a bodiless through-neck structure running full length of the instrument and having a thickened portion, near one end, configured with a module-mounting channel traversing across the through-neck structure, the channel being dimensioned and arranged to mount said pickup module in the operational disposition and to enable the easy installation and removal of said module without disturbing the strings.

17. The stringed musical instrument as defined in claim 16 wherein said pickup module comprises:

a main enclosure, made from dense solid non-sheet material selected from a group including plastic, metal, wood and solid composite material, and made in a process selected from a group including machining, molding and casting, having a front surface and a rear surface connected by peripheral walls, configured with a plurality of recessed compartments, each extending inwardly from the rear surface, configured and arranged to accommodate a plurality of components, controls and interconnections associated with said pickup so as to render said pickup module substantially self-contained;

a first user-operable volume control and a first user-operable tone control, operationally associated with said first pickup, contained and mounted in a corresponding one of the compartments; and an output jack, operationally associated with the components of said module, contained and mounted in a corresponding one of the compartments.

18. The stringed musical instrument as defined in claim 17 wherein said pickup module further comprises:

a second pickup contained and mounted in a corresponding one of the compartments;

a second user-operable volume control and a second user-operable tone control, operationally associated with said second pickup, contained and mounted in a corresponding one of the compartments; and a user-operable function switch, operationally associated with said first and second pickups, contained and mounted in a corresponding one of the compartments.

19. The stringed musical instrument as defined in claim 18 wherein said pickup module further comprises:

an electronic buffer circuit unit, having a first portion operationally associated with said first pickup, said first volume control and said first tone control and having a second portion operationally associated with said second pickup, said second volume control and said second tone control, contained and mounted in a corresponding one of the compartments; and a battery, rated and arranged to power said electronic buffer circuit unit, contained in a corresponding one of the compartments.

20. The stringed musical instrument as defined in claim 19 wherein, in said pickup module:

said first and second pickups are disposed in a manner to each sense a corresponding half of the designated number of the strings; and said function switch is configured and arranged to provide user selection between stereo and mono modes of operation of said first and second pickups.

21. The stringed musical instrument as defined in claim 20 wherein, in said pickup module:

the designated number of strings is ten; and said first and second pickups are disposed in a manner to each sense a corresponding group of five strings.

22. The stringed musical instrument as defined in claim 19 wherein, in said pickup module:

said first and second pickups are disposed in a manner to each sense all of the designated number of strings at different displacements from one end thereof; and said function switch is configured and arranged to provide user selection between said first and second pickups as a signal source to be delivered as output at said output jack.

23. The stringed musical instrument as defined in claim 22 wherein the designated number of strings is six.

24. The stringed musical instrument as defined in claim 22 wherein the designated number of strings is four.

25. A compartmentalized pickup module, for a stringed musical instrument having a designated number of strings, comprising:

a main enclosure, fashioned from a slab of solid material, configured and arranged to provide a front surface, a rear surface, a plurality of perimeter regions and a plurality of recessed compartments for accommodating a plurality of components including at least a first pickup along with controls and interconnections associated with the pickup, so as to thus enable the assembly of said module as a self-contained unit and deployment thereof in an operational disposition for sensing at least a portion of the designated number of strings; and a pickup disposed in a compartment of said main enclosure, said main enclosure being shaped peripherally in a substantially symmetrical manner and said pickup being located substantially offset from center of said main enclosure thus enabling said module to be installed in either of two opposite orientations, each of which provides a different longitudinal disposition of said pickup along the strings and thus a different timbral quality.

26. The stringed musical instrument as defined in claim 17 wherein said enclosure is configured and arranged to define a six-sided perimeter pattern of adjoining flat facets having surfaces substantially perpendicular to the front and rear surfaces, the perimeter pattern consisting of three pairs of facets, each pair consisting of two substantially parallel facets of substantially equal length located at opposite edges of said enclosure, the perimeter pattern being shaped and dimensioned to define a predetermined total front surface area of said enclosure such that, when said module is mounted in place in the channel of the through-neck structure of said bodiless instrument with two portions of said enclosure extending beyond opposite edges of the through-neck structure, each extending portion is made to have a front surface area less than one quarter the area of the total front surface area.

27. The compartmentalized pickup module enclosure as defined in claim 25 wherein said main enclosure portion is configured with six distinct perimeter regions comprising:

a first perimeter region, configured and arranged to define an opening for battery access and replacement;

a second perimeter region, configured and arranged to mount at least one user control associated with the pickup unit;

a third perimeter region, configured and arranged to mount an audio output jack;

a fourth perimeter region, associated with an adjacent compartment configured and arranged to mount the pickup unit in a location offset from a center line of said enclosure, thus enabling selection between two opposite mounting orientations of said enclosure each providing a musically different longitudinal location of the pickup unit relative to the strings;

a fifth perimeter region, configured and arranged to mount a user-operable function switch; and a sixth perimeter region, configured and arranged to provide capability of mounting at least one user control.

* * * * *